United States Patent [19]

Jurgensen

[11] 3,990,064

[45] Nov. 2, 1976

[54] ALARM INDICATOR RESPONSIVE TO IMPROPER POSITION OF A CONTROL LEVER

[76] Inventor: Richard L. Jurgensen, 2201 Sherwood Drive, South Daytona, Fla. 32019

[22] Filed: Oct. 6, 1975

[21] Appl. No.: 619,961

[52] U.S. Cl. ..... 340/267 R; 340/282

[51] Int. Cl.[2] ..... G08B 21/00

[58] Field of Search ..... 340/282, 267 R, 421; 200/61.85, 61.86, 86.87, 61.58 R

[56] References Cited

UNITED STATES PATENTS 1,236,526 8/1917 Zabel ..... 200/61.87

2,036,171 3/1936 Fox ..... 340/267 R

*Primary Examiner*—Glen R. Swann, III

*Attorney, Agent, or Firm*—Julian C. Renfro

[57] ABSTRACT

A sensing arm of an alarm unit is operably associated with a control lever, and arranged to sense the position of the lever. Alarm means are operatively connected to the sensing means and serving to alert an operator when the lever is disposed in an undesirable position, so that he can take corrective action. In order to prevent undesirable sounding of the alarm means, I utilize a position sensitive disabling means operatively connected to the alarm means, to accomplish the inhibiting thereof under certain selected conditions such as when the device controlled by the lever is being serviced.

6 Claims, 7 Drawing Figures

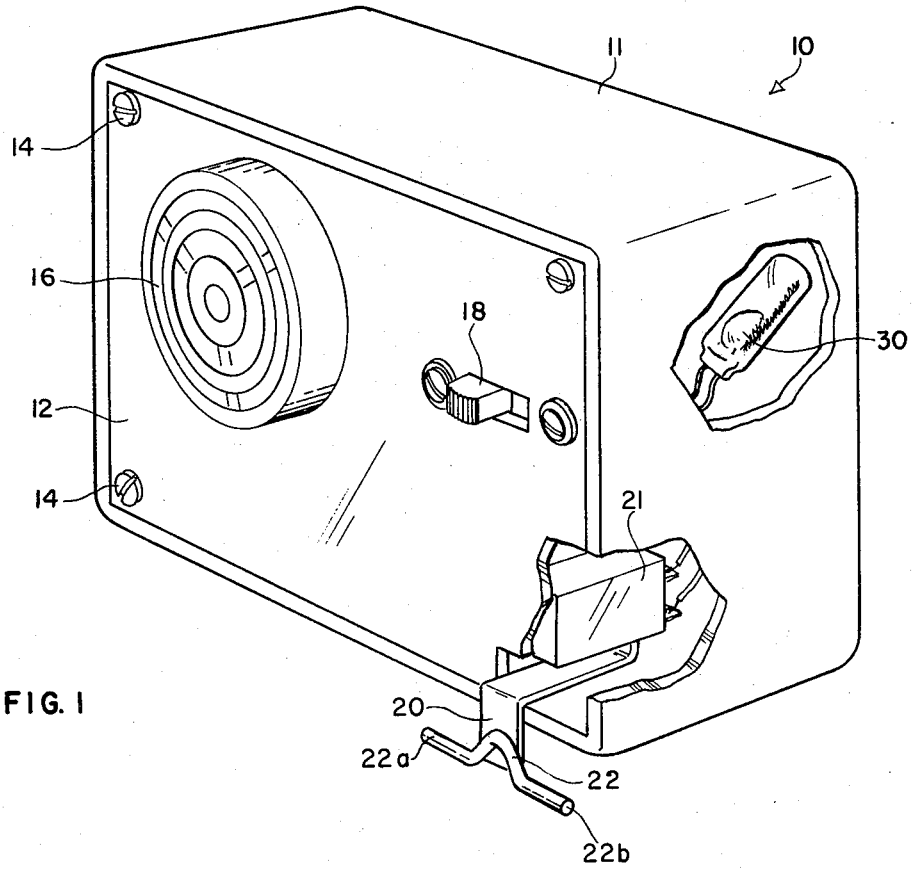
FIG. 1
FIG. 2
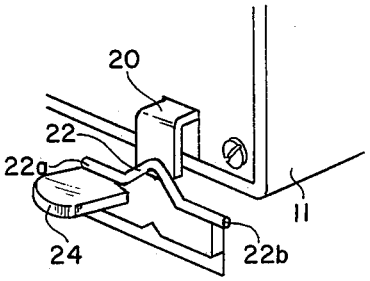
FIG. 3
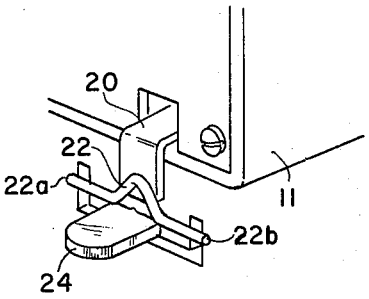
FIG. 4
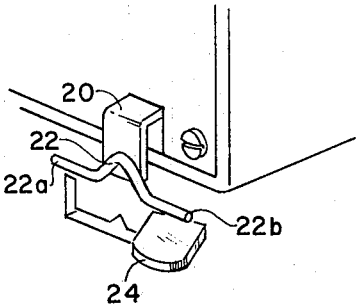
FIG. 5
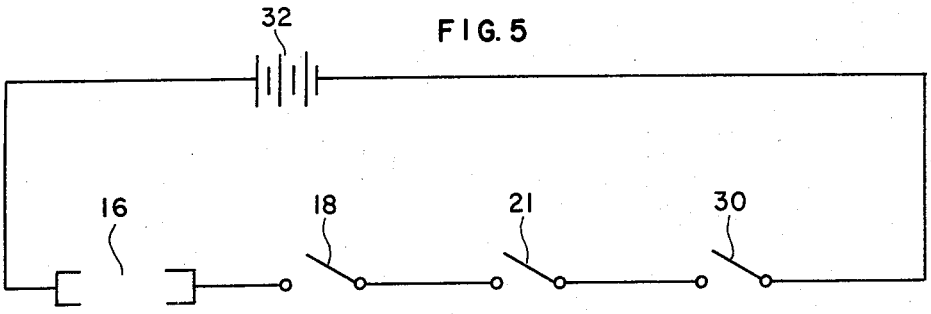

ALARM INDICATOR RESPONSIVE TO IMPROPER POSITION OF A CONTROL LEVER

BACKGROUND OF THE INVENTION

There are certain machines on the market equipped with manually operable levers and the like that are manipulated at one time or another between different operational positions, or between an operative position and an interim position. For some of such machines, it is undesirable to perform certain phases of an operation with the lever in a specific position. Unfortunately, when no alarm unit is built into such a machine or apparatus, the operator often forgets to restore the lever to the proper operative position, thus resulting in faulty performance of the machine.

Illustrative of this type of situation is the widely-used Computer Printer manufactured by International Business Machines, designated the 5203 Printer, although my invention is obviously not to be limited to use with such a machine. The IBM Computer Printer utilizes continuous form computer paper, with it being necessary from time to time to replenish the supply of paper in the machine, or to change to a different form or type of paper. In order to do so, it is necessary to release a portion of the machine, known as the rear unit, from the closed position, and tilt it rearwardly, away from the operator. It is further necessary to disengage the clutch associated with paper movement to permit alignment of the forms after replenishment or substitution of paper, but unfortunately, the typical operator from time to time forgets to re-engage the carriage clutch after the paper loading operation has been completed, and the rear unit returned to the closed position. In the instance at hand, the carriage clutch mechanism is engaged or disengaged by a small finger-operated lever disposed on the carriage clutch unit of the machine. The finger operated lever, known as a space select lever, has left and right operational positions, with the left operational position providing printing at 6 lines per inch, and the right operational position providing printing at 8 lines per inch.

The center position for this lever is a carriage clutch disengaging position, and it is to this position that this lever must be moved to allow for proper alignment after the paper has been reloaded in the machine. No warning device is presently associated with the space select lever, and it is therefore easily possible for the operator to fail to move this lever away from the center or interim position, back into an operative position, when the reloading operation has been accomplished. The consequence of a failure to move the lever back into an operative position is that the paper does not move through the machine, and the machine will continue to print at a single location on the paper, with this pile-up of printing obviously resulting in completely unintelligible words.

When this event happens, the difficulty is not completely remedied merely by moving the finger-operated lever to one or the other of the operative positions, for the machine must be reset and restarted so that the overprinted material can be rerun. It is quite apparent that the failure to reset the finger-operated space select lever to an operative position can become quite expensive when it is realized that the typical rerun of a job involves operator salary, machine and materials cost, and overhead.

It is to prevent oversights of this type that I have evolved the instant Alarm Unit which, despite its low cost, is quite effective in reminding the operator to engage the carriage clutch of the associated machine before placing it back in operation after a paper reloading cycle, or a paper alignment adjustment.

SUMMARY OF THIS INVENTION

In accordance with the present invention, I have provided a low-cost alarm unit or warning device for use with a machine or other apparatus having a manipulative lever movable between operational and interim positions, and for which attempted operation in any interim position is undesirable, with such unit comprising a housing in which circuit means are contained. The circuit means includes an operator-alerting device, and its power source, and a principal switch, with such components being connected in series relation, and such alarm or operator-alerting device energized when the switch is closed.

The principal switch has a movable actuating arm, and the switch is equipped with electrical contacts that are movable between a circuit-completing or closed position, and circuit-breaking or open position, with such positions being effected in response to certain movements of the actuating arm.

The actuating arm is equipped with means for sensing the position of the lever, and when this arm is in a position corresponding to an operational position of the lever of the machine, this causes the switch contacts to break the circuit, and this of course renders the operator-alerting device desirably silent. On the other hand, when the arm is in a position corresponding to an interim or neutral position of the lever, the contacts are permitted to close, thus completing the circuit and bringing about the functioning of the operator-alerting device.

In applying my invention to the 5203 Printer of IBM, the housing I use is typically of a small size, enabling it to be easily attached without damage or modification to an upper portion of the carriage clutch unit of the Computer Printer. The actuating arm of the alarm unit typically projects through a side of the housing, with such arm having an active portion configured to contact the clutch lever of the carriage clutch unit. More particularly, the active portion designed to contact the lever of the machine is configured to have multiheight lever-contacting portions, involving first and second height levels. As a result of this arrangement, the switch contacts will be maintained in a circuit breaking position when one of the first height level portions are contacting the lever, and in a circuit-completing position when a second height level portion is contacting the lever. I am obviously not to be limited to any particular configuration of the active portion of the actuating arm, but in one instance I utilize an active portion in the form of an upside down V having laterally-extending arms, with the operator-alerting device being actuated when the lever resides within the confines of the V, but with the operator-alerting unit being disengaged when the lever is on either side of the V shaped portion, at which time it is in contact with one or the other of the laterally-extending arms that may constitute the first height level.

As will be seen, my invention may be readily applied to an existing machine without alteration to any of the components of the machine, or voiding any warranties or service agreements.

In a preferred embodiment, the principal switch is normally closed, which of course means that the operator will be alerted at any time that the arm of the switch is not contacted by the lever when disposed in an operative position. Further, it may be desirable to provide an arrangement in which the operator-alerting portion of the device is disabled whenever the housing is moved away from the normal operational position. For example, when used on the aforementioned Computer Printer, the carriage clutch unit is tilted rearwardly during the paper reloading procedure, and at this time, the carriage clutch lever is moved to a neutral position to allow proper positioning of the forms. With the lever in a neutral position, the active portion of the switch arm is of course separated from contact with the carriage clutch lever of the machine. Inasmuch as I prefer to utilize a normally-closed principal switch, this would result in an arrangement in which the operator-alerting device or alarm would sound continuously. To prevent this, I may provide a disabling means in the form of a position-sensitive switch in series with the other circuit components, which causes the circuit to be desirably broken during the paper reloading procedure. As an example of the position-sensitive switch, I may use a mercury switch so disposed that only when the carriage clutch unit has been returned to the essentially vertical position will the circuit again be completed. Other switches may of course include an on-off switch disposed in an easily accessible position on the housing so that the alarm unit may be turned off when the computer printer is not in use, or when the paper movement is stopped during certain machine checkout procedures.

It is therefore a principal object of my invention to provide a self-contained, low-cost alarm unit adapted for use with a variety of machines, and serving to remind the machine operator of an improper position of a lever, handle, switch, or other component.

Another object of my invention is to provide an inexpensive yet highly effective device for alerting an operator or attendant to an improper condition of a machine, which device can be attached without it being necessary to modify or deface the machine in any way.

It is yet another object of my invention to provide a warning device involving only simple, inexpensive circuitry components, yet able to effect a savings of many dollars in operating costs of a machine by making unnecessary any wasteful, time-consuming reruns.

Other objects, features and advantages of my novel warning device will be more apparent as the description proceeds.

BRIEF DESCRIPTION OF DRAWINGS

FIG. 1 is a perspective view of an alarm unit or warning device in accordance with an exemplary embodiment of my invention, with portions of the housing broken away to reveal internal construction;

FIGS. 2 through 4 are related fragmentary views, revealing various positions in which the space select lever of an associated Computer Printer may be placed, and the resultant relationship of the actuating arm of my device thereto;

FIG. 5 is a simplified showing of a typical circuit that may be utilized in accordance with my invention;

DETAILED DESCRIPTION

Figure 7:
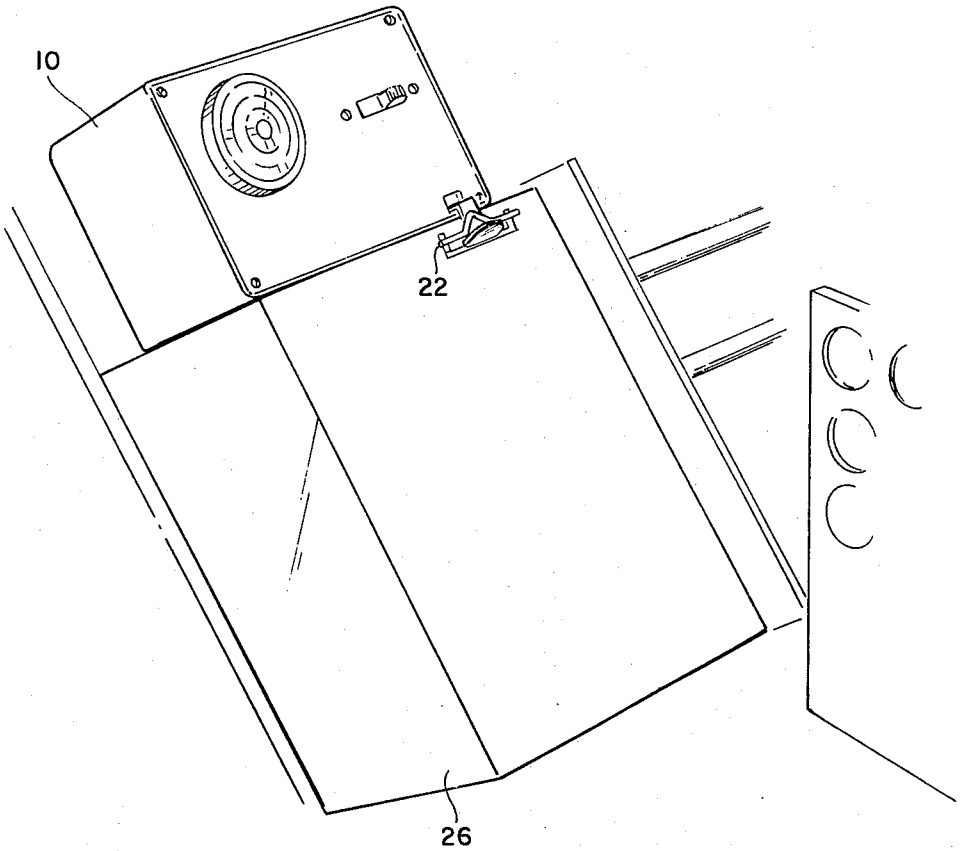
FIG. 7 is a view generally along the lines of FIG. 6, but showing the carriage clutch unit in the position to which it is tilted at the time the paper supply of the machine is to be changed or replenished.

Turning now to FIG. 1, it will there be seen that a preferred embodiment of my novel alarm unit 10 may involve a housing 11, which for example may be made of plastic and measure approximately 1½ by 3 by 4 inches. The housing 11 is typically equipped with a removable front plate 12 held in place by a plurality of small screws 14, which may be located in the corners of the plate. However, I am obviously not to be limited to these constructional details.

The front plate 12 may be utilized as the support for the operator-alerting device or alarm means 16, which may be a commercially-available audio alarm device and power source therefor. One such commercially available device is marketed under the trade name "Sonalert." This latter device emits a piercing sound when a voltage of say 9 volts is impressed across it. Alternatively, a signal lamp may be used to provide a visual warning, or a combinational arrangement for alerting the operator may be utilized. The front plate or panel 12 may also serve as a support for an on-off switch 18, that also may be of conventional type.

As will be noted from FIG. 1 as well as fragmentary FIGS. 2 through 4, a lower portion of the front panel 12 may be slotted so as to permit the actuating arm 20 of the principal switch used in the device to pass through. The principal switch 21 may be of any of several types, such as a microswitch for example. Microswitches are available in a wide variety of types and sizes, and obviously my invention is not to be limited to any particular type or size. However, when my device is to be used with an IBM Computer Printer, I prefer to utilize a normally-closed switch equipped with an actuating arm 20 of substantial length.

Figure 6:
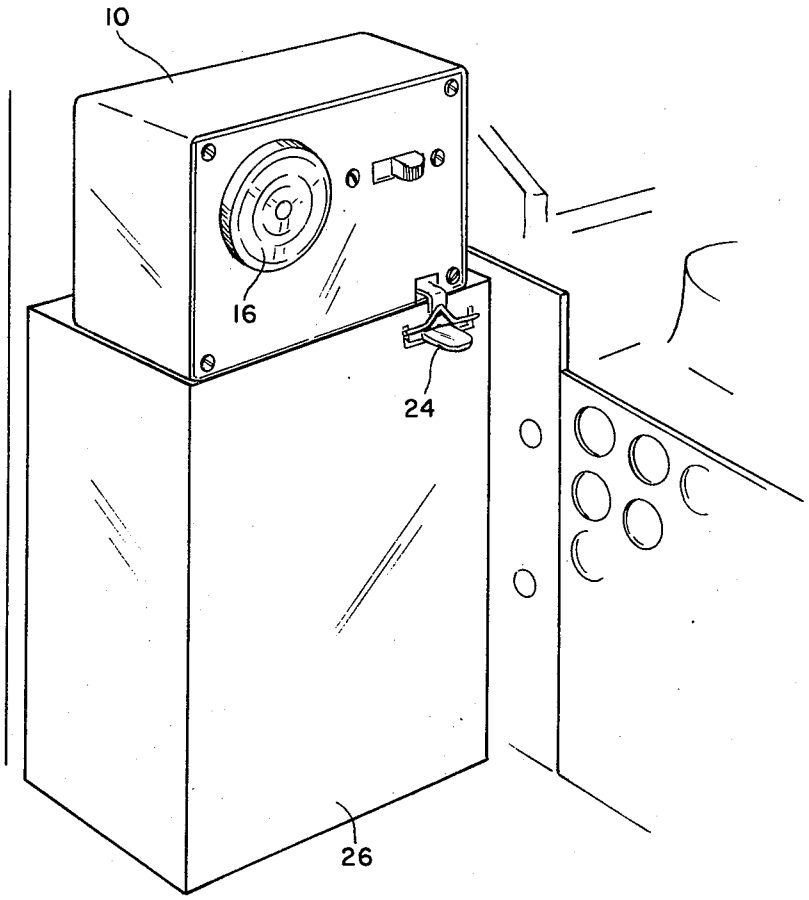
FIG. 6 is a perspective view showing the alarm unit in accordance with my invention placed in operative relationship atop the carriage clutch unit of an associated Computer Printer.

As will be seen from FIGS. 2 through 4, the outermost part of the actuating arm 20 is equipped with an active portion 22 that is configured so as to interact in a certain way with the finger-operated space select lever 24 associated with the carriage clutch unit 26 of the machine; see FIGS. 6 and 7. Accordingly, I may refer to the switch 21 and its actuating arm as the sensing means arranged to sense the position of the lever of an associated machine or apparatus.

As viewed in FIG. 2 for example, the space select lever 24 may reside in a notch representing an operative position on the left, in which position the machine will print at the rate of 6 lines per inch. Alternatively, the finger operated lever may be moved to, and positioned in, a notch in the right hand position, as shown in FIG. 4, in which event the printer is caused to print at the rate of 8 lines per inch. The lever 24 is biased upwardly, so as to reside properly in the selected notch, and in either instance, because of the specific configuration of the active portion 22, the actuating arm 20 will be held in an upper or raised position, which causes the series circuit of the device to be broken, thus preventing the alarm or operator-alerting device 16 from sounding.

When the finger operated lever 24 has been moved to the interim or neutral position shown in FIG. 3 that is associated with the disengagement of the carriage clutch, the lever is caused to be disposed directly under the central portion of the active surface 22 of the arm.

The active surface, in the preferred embodiment illustrated in FIGS. 1 through 4, is of multiheight configuration, in which first and second height levels are involved. More particularly, the active surface is somewhat in the shape of an inverted V, with laterally-extending arms attached to, or integral with, the arms of the V. In such an arrangement, the laterally-extending arms constitute first height level portions, and the interior portion of the inverted V constitutes the second height level portion. Because of this arrangement, when the finger operated space select lever 24 is in its center or neutral position, the arm 20 is allowed to drop and the microswitch 21 to close, whereas when the finger operated lever 24 is in either of its operational positions, it is contacted by one or the other of the laterally-extending arms of the active portion 22 of the actuating arm, with the result that the principal switch 21 is manipulated to a circuit breaking position in which the operator-alerting device 16 is prevented from operating.

Also visible in FIG. 1 is a disabling means in the form of a position-sensitive switch, such as a mercury switch 30, which is secured to a sidewall of the housing 11. The mercury switch is typically oriented in such a way that only when the housing 11 is in the essentially vertically-disposed position illustrated in FIG. 1 and FIG. 6 is the circuit completed, with any rearward, tilting type movement of the housing as shown in FIG. 7, preventing the completion of the circuit and therefore effectively inhibiting the operation of the operator-alerting device 16.

As mentioned previously, the space select lever 24 of the 5203 Printer is spring biased upwardly, and movable into one or the other of two vertically disposed slots, which slots are associated with the 6 lines per inch position and the 8 lines per inch position. If the operator fails to properly position the lever 24 such that it actually enters the selected slot, it will remain in a somewhat lower position, and quite significantly, even though the lever no longer resides within the inverted V portion of the active surface 22 of the arm 20, my device will serve, because of the configuration and positioning of the active surface, to cause the alarm to sound that will summon the operator.

Turning to FIG. 5, it will be seen that I have illustrated a simplified schematic of the preferred circuit utilized in accordance with this invention, involving the operator-alerting device 16 and a battery 32, such as a 9 volt dry cell, which constitute the alarm means of my device. These are in series relation with the on-off switch 18, the principal switch 21, and the mercury switch 30. As is obvious to one skilled in the art, the operator-alerting device 16 cannot operate unless all of the switches of this series circuit are in a closed position.

Turning now to FIG. 6, the carriage clutch unit 26 of a 5203 Printer is revealed in its upright, operational position, with my device mounted on top of the unit, and with the active portion 22 of the arm 20 disposed closely adjacent the space select lever 24 of the carriage clutch unit. It is desirable not to drill holes in the carriage clutch unit in order to mount my device, or in any way mar or damage the Computer Printer, so I prefer to place a pressure sensitive adhesive along the underside of the housing 11, with this adhesive normally being protected by a peelable covering. After the operator has carefully ascertained the proper position of the alarm device atop the carriage clutch unit, he or she then peels off the backer or covering, and firmly attaches the housing to the carriage clutch unit. Inasmuch as I prefer the use of a dry cell battery as the power source, my unit is entirely self-contained.

Referring to FIG. 7, in this instance the carriage clutch unit has been moved rearwardly to an inoperative position, as will enable a supply of a different type of form, for example, to be installed in the machine. In order to enable the installation of the new forms in the machine, it is necessary to move the space select lever 24 to the interim or clutch-disengaging position. In such instance, the arm 20 of the principal switch is moved to a position corresponding to the closed position of the contacts of the microswitch, and this would result in the functioning of the operator-alerting device 16 were it not for the fact that the preferred embodiment of my invention includes the use of the previously mentioned disabling means 30 that prevents completion of the circuit during the tilting of the carriage clutch unit.

One particular embodiment of my invention involved the utilization of the following commercially-available components:

Housing 11 - Calectro Phenolic Chassis Box No. H4-725.

Switch 21 - Archer SPDT Lever Switch No. 275-1102.

Switch 18 - Calectro Slide Switch No. E2-110.

Alerting Device - Mallory Sonalert No. SC628.

Quite obviously, other components more suitable for a given installation can, within the spirit of my invention, easily be substituted for those specified above.

By way of further illustration of the value of my invention to the operator of an IBM 5203 Printer, the following is a typical sequence that may ensue at such time as it is desired to change the type of form being utilized in such machine. Although many of the mentioned components are not illustrated herein, these components will be immediately recognized by one familiar with the 5203 machine.

1. The printer top cover is opened and the rear unit is tilted back, away from the operator.
2. This movement of the rear unit necessarily tilts the carriage clutch unit rearwardly, which in turn causes the mercury switch or other such disabling means in my device to function, to prevent undesirable sounding of the alarm means utilized.
3. The operator then opens the forms tractors used for providing paper motion, and removes the paper therefrom.
4. The operator opens a sliding door and pulls the forms chute forward to the forms loading position.
5. The operator then inserts the new forms, feeding the first form up the forms chute. He or she then pulls the forms up and lays them back across the tractor assembly.
6. The forms are placed in the form tractors, making certain that the tractors keep tension across the form.
7. The forms are fed under the pressure rollers, with the operator making certain that the outside edges of the rollers are aligned approximately with the center of the pin feed holes.
8. The tractor lateral adjustment knob of the machine is manipulated to align forms with print positions, and pressure roller tension is set in accordance with the forms being used.

9. The carriage clutch unit is disengaged, with this of course involving the manipulation of the lever described hereinabove as lever 24.
10. The operator advances the forms, utilizing the vertical adjustment knob of the machine until crease between forms is aligned with the upper scribe line on the forms guide, with this procedure serving to align forms for printing first line.
11. After the forms are thus in the proper position, the operator presses the appropriate carriage restore key, and inasmuch as the carriage clutch as of this moment is still out of gear, the operator can align the paper.
12. This being done, the operator now should engage the carriage clutch, setting the space select lever to either 6 lines per inch or 8 lines per inch, and then close the rear unit.

Unfortunately, even experienced operators from time to time close the rear unit without re-engaging the carriage clutch, with this having the effect of allowing the Printer to print on a single line, inasmuch as the forms are not moved upwardly, with this of course resulting in a single black line of unintelligible printing, and necessitating an expensive rerun at such time as the operator later discovers the oversight.

As should be obvious, my device is not limited to use with the IBM 5203 Printer, nor for that matter is it limited to use with a printing type device, for it manifestly can be adapted for use with a variety of machines having levers or switches that an operator may forget to return to a proper operational position after certain operations, and for which attempted operation in the nonoperational position is undesirable.

With certain modifications, my device can be made to satisfactorily operate with a machine having two neutral positions of the clutch associated with paper movement, such as is to be found in the IBM 1403 Printer.

I claim:

1. A warning device for use with an apparatus having a lever movable to a plurality of positions during operation of the apparatus, in which at least one position of the lever is undesirable, said device comprising:

sensing means operably associated with the lever, and arranged to sense the position of the lever, alarm means operatively connected to said sensing means, said alarm means responsive to said sensing means and serving to alert an operator when the lever is disposed in an undesirable position, and disabling means operatively connected to said alarm means, to accomplish the inhibiting thereof under certain selected conditions, said disabling means being position sensitive.

2. The warning device as defined in claim 1 in which said sensing means comprises a switch having an actuating arm as well as electrical contacts moved between circuit-completing and circuit-breaking positions as a result of movements of said actuating arm, said actuating arm having an active surface for accomplishing the sensing of the position of the lever.

3. The warning device as defined in claim 2 in which said active surface is of a multiheight configuration, in which first and second height levels are involved, with the contacts of said switch being maintained in a circuit-breaking condition when one of the first height level portions are contacting the lever, and in a circuit-completing condition capable of bringing about actuation of said alarm means when a second height level portion is contacting the lever.

4. An alarm unit for use with a machine having a manipulative lever movable between operational and interim positions, said unit comprising a housing, circuit means contained in said housing, said circuit means including an electrically powered operator-alerting device and a principal switch connected in series relation with a source of electrical power, said switch having a movable actuating arm movable in response to the position of said lever, and having electrical contacts movable between a circuit-completing position and a circuit-breaking position, with such positions being effected in response to certain movements of said actuating arm, said arm, when in a position corresponding to an operational position of the lever of the machine, causing said contacts to break said circuit, thus rendering said operator-alerting device silent, whereas when said arm is in a position corresponding to an interim position of the lever, then causing said contacts to complete said circuit, with the resultant functioning of said operator-alerting device, and position-sensitive disabling means for inhibiting the operation of said operator alerting device under certain selected conditions.

5. The alarm unit as defined in claim 4 in which said actuating arm has an active portion designed to contact the lever of the machine, said active portion having multiheight lever - contacting portions involving first and second height levels, such that said switch will be maintained in a circuit-breaking position when one of the first height level portions are contacting the lever, and in a circuit-completing position capable of bringing about actuation of said operator - alerting device when a second height level portion is contacting the lever.

6. The alarm unit as defined in claim 4 in which adhesion means are located on the underside of the said housing, enabling it to be installed in an operative position on a machine without causing marring or damage thereto.

* * * * *